US006932649B1

(12) United States Patent
Rothermel et al.

(10) Patent No.: US 6,932,649 B1
(45) Date of Patent: Aug. 23, 2005

(54) ACTIVE WAFER FOR IMPROVED GIGABIT SIGNAL RECOVERY, IN A SERIAL POINT-TO-POINT ARCHITECTURE

(75) Inventors: Brent Ryan Rothermel, Harrisburg, PA (US); Chad William Morgan, Mechanicsburg, PA (US); Alex Michael Sharf, Harrisburg, PA (US); David Wayne Helster, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/804,646

(22) Filed: Mar. 19, 2004

(51) Int. Cl.[7] ..... H01R 13/66
(52) U.S. Cl. ..... 439/620; 439/76.1
(58) Field of Search ..... 439/620, 76.1, 439/608, 79, 108, 701, 712

(56) References Cited

U.S. PATENT DOCUMENTS

| | | | | |
|---|---|---|---|---|
| 4,603,320 | A | 7/1986 | Farago | 340/347 DD |
| 5,046,955 | A | 9/1991 | Olsson | 439/74 |
| 5,118,300 | A | 6/1992 | Zarreii | 439/79 |
| 6,168,469 | B1 | 1/2001 | Lu | 439/608 |
| 6,538,525 | B1 | 3/2003 | Williamson | 333/20 |
| 6,607,402 | B2 * | 8/2003 | Cohen et al. | 439/608 |
| 6,623,310 | B1 * | 9/2003 | Billman et al. | 439/701 |
| 6,638,079 | B1 * | 10/2003 | Billman et al. | 439/76.1 |
| 6,638,110 | B1 * | 10/2003 | Billman | 439/608 |
| 6,641,438 | B1 * | 11/2003 | Billman | 439/608 |
| 6,645,009 | B1 * | 11/2003 | Billman et al. | 439/608 |
| 6,645,010 | B1 * | 11/2003 | Billman et al. | 439/608 |
| 6,648,689 | B1 * | 11/2003 | Billman et al. | 439/608 |
| 6,652,319 | B1 * | 11/2003 | Billman | 439/608 |
| 6,655,966 | B2 * | 12/2003 | Rothermel et al. | 439/76.1 |
| 6,663,401 | B2 * | 12/2003 | Billman et al. | 439/76.1 |
| 6,663,426 | B2 * | 12/2003 | Hasircoglu et al. | 439/608 |
| 6,663,427 | B1 * | 12/2003 | Billman et al. | 439/608 |
| 6,663,429 | B1 * | 12/2003 | Korsunsky et al. | 439/608 |
| 6,666,692 | B2 * | 12/2003 | Billman et al. | 439/76.1 |
| 6,672,886 | B2 * | 1/2004 | Billman | 439/82 |
| 6,676,450 | B2 * | 1/2004 | Schroll | 439/608 |
| 6,682,369 | B1 * | 1/2004 | Korsunsky et al. | 439/608 |
| 6,685,488 | B2 * | 2/2004 | Billman et al. | 439/108 |
| 6,692,272 | B2 * | 2/2004 | Lemke et al. | 439/108 |
| 6,692,305 | B2 * | 2/2004 | Nelson et al. | 439/608 |
| 6,709,298 | B2 * | 3/2004 | Bradley | 439/701 |
| 6,712,646 | B2 * | 3/2004 | Shindo | 439/608 |
| 6,739,910 | B1 * | 5/2004 | Wu | 439/608 |

(Continued)

*Primary Examiner*—Ross Gushi

(57) ABSTRACT

An electrical connector is provided for operation in a point-to-point application. The connector includes an insulated housing having first and second card interfaces configured to mate with associated first and second circuit cards. An electrical wafer is held in the housing and configured to operate in a point-to-point architecture. The signal traces end at signal contact pads located proximate to first and second edges, respectively. The signal contact pads receive a unidirectional signal. Each of the signal traces include a break section at an intermediate point along a length thereof to form a disconnect in the signal traces. The connector further includes an active compensation component bridging the break section in the signal traces. The active compensation component compensates the differential signal incoming from the input contact pads for signal degradation and transmits a compensated signal outward to the output contact pads. The active compensation component transmits the signal only in a single direction within the point-to-point architecture.

20 Claims, 6 Drawing Sheets

U.S. PATENT DOCUMENTS 6,739,918 B2 * 5/2004 Cohen et al. ..... 439/701
6,743,057 B2 * 6/2004 Davis et al. ..... 439/701
6,746,278 B2 * 6/2004 Nelson et al. ..... 439/608
6,749,468 B2 * 6/2004 Avery ..... 439/701
6,764,320 B1 * 7/2004 Lenoir et al. ..... 439/101
6,769,935 B2 * 8/2004 Stokoe et al. ..... 439/608
6,773,305 B2 * 8/2004 Wu ..... 439/608
6,776,629 B2 * 8/2004 Shuey ..... 439/108
6,776,649 B2 * 8/2004 Pape et al. ..... 439/485
6,776,659 B1 * 8/2004 Stokoe et al. ..... 439/608
6,780,058 B2 * 8/2004 Mizumura et al. ..... 439/608
6,780,059 B1 * 8/2004 Payne et al. ..... 439/608
6,790,088 B2 * 9/2004 Ono et al. ..... 439/607
6,790,089 B2 * 9/2004 Wu ..... 439/608
6,808,399 B2 * 10/2004 Rothermel et al. ..... 439/108
6,808,419 B1 * 10/2004 Korsunsky et al. ..... 439/607
6,808,420 B2 * 10/2004 Whiteman et al. ..... 439/608
6,811,414 B1 * 11/2004 Consoli et al. ..... 439/79
6,811,440 B1 * 11/2004 Rothermel et al. ..... 439/608
6,814,619 B1 * 11/2004 Stokoe et al. ..... 439/608
6,824,391 B2 * 11/2004 Mickievicz et al. ..... 439/61
6,827,611 B1 * 12/2004 Payne et al. ..... 439/608
6,837,720 B2 * 1/2005 Hicks et al. ..... 439/79
6,843,686 B2 * 1/2005 Ohnishi et al. ..... 439/608
6,843,687 B2 * 1/2005 McGowan et al. ..... 439/608

* cited by examiner 170
184
184
186
188
174
168
130
162
132
134
172
172
172
172
172
166
178
176
176
176

ACTIVE WAFER FOR IMPROVED GIGABIT SIGNAL RECOVERY, IN A SERIAL POINT-TO-POINT ARCHITECTURE

BACKGROUND OF THE INVENTION

Embodiments of the present invention generally relate to an electrical connector for use with point-to-point serial data streams and particularly to connectors that compensate for signal loss within point-to-point data streams.

In the past, right angle connectors have been provided for connection between printed circuit boards. The right angled connectors may use a large plurality of receiving terminals oriented at a right angle to an equally large plurality of pins. One common implementation of such connectors is to join daughter cards with a backplane in a data transmission system. In conventional systems, connectors have been proposed that are able to support bi-directional data streams arranged in a multi-drop bus configuration. These conventional bi-directional data streams conveyed signals in opposite directions over each individual trace through the connector.

Existing multi-drop bus architectures utilize a single driver or transmitter, such as arranged on one daughter card that transmits a signal along a trace along the backplane. This trace on the backplane is tapped at multiple locations to feed a plurality of receivers on an equal plurality of daughter cards. Hence, a single transceiver (transmitter/receiver) on a first daughter card may communicate along a common trace over the backplane to a plurality of transceivers arranged on separate other daughter cards.

However, conventional configurations have experienced certain disadvantages at high data rates. As the data rate increases, the high frequency components of the signal experience more loss and more reflection within the backplane and connector assemblies interconnecting the daughter cards. Signal degradation increases as the number of daughter cards increases that tap into a single trace along the backplane. For example, as the data rate increases, each signal trace, within an individual connector extending to the daughter cards, begins to function more as a transmission line. As the traces extending to each daughter card exhibit more characteristics of transmission lines, the energy conveyed along the backplane divides at each point where a daughter card connector tapped into a trace on the backplane. The more times the energy is split, the more reflection and loss is experienced. Conventional connectors have attempted to reduce the negative effects of the multi-drop bus architecture by providing a bus arbitration logic chip as a switch within a bi-directional communications link. One example of such a configuration is illustrated in U.S. Pat. No. 6,168,469.

However, bi-directional communication format and multi-drop bus architectures continue to exhibit signal degradation and reliance problems. Hence, bi-directional communications and multi-drop bus architectures are becoming less frequently used and are no longer desirable in certain applications. Instead, an entirely different communications format and connector architecture are now being advanced, namely serial communication over a point-to-point architecture. In serial communication over a point-to-point architecture, each transmitter is uniquely associated with a single receiver to afford a distinct and separate communications link therebetween. In a point-to-point architecture, only as single daughter card taps into a single trace along the backplane. Each transmitter and receiver upon each daughter card is afforded a dedicated communications path and dedicated traces both within the connector and along the backplane. Conventional approaches, such as described in the '469 patent, are not useful nor afford any advantage in point-to-point architectures.

Hence, a need remains for an improved connector assembly designed for a point-to-point architecture that conveys serial data streams.

BRIEF DESCRIPTION OF THE INVENTION

An electrical connector is provided for connection to a point-to-point architecture. The connector includes an insulated housing having first and second card interfaces configured to mate with associated first and second circuit cards. An electrical wafer is held in the housing and configured to interconnect circuit boards in a point-to-point architecture. The wafer has first and second interfaces. The wafer has signal traces that end at input and output contact pads located proximate to first and second interfaces, respectively. The input contact pads receive a serial signal, while the output contact pads transmit the serial signal. Each of the signal traces include a first break at an intermediate point along a length thereof to form a disconnect in the signal traces. The connector further includes an active compensation component bridging the first breaks in the signal traces. The active compensation component compensates for signal degradation within the point-to-point architecture for the signal incoming from the input contact pads and transmits a compensated signal outward to the output contact pads. The active compensation component transmits the signal only in a single direction within the point-to-point application.

Optionally, the active compensation component may include preemphasis signal conditioning for conditioning the signal incoming from the input contact pads. The preemphasis signal conditioning increases, within a band of frequencies, a magnitude of higher frequency components of the signal with respect to a magnitude of lower frequency components of the signal.

The wafer also includes one or more power contact pads thereon. Optionally, the power contact pads may be located at one of the interfaces, while a power trace extends from the contact pad to the active compensation circuit. Optionally, the wafer may be configured such that the active compensation component and the power contact pad are located on a first side of the wafer, while a power trace is located on the second side of the wafer with the power trace interconnecting the power contact pad and the active compensation component through vias extending through the wafer.

As a further option, passive signal compensation components may be provided on the wafer in addition to the active compensation components. The passive signal compensation components may be provided upstream of the active compensation component such that the passive signal components are located between the input contact pads and the active compensation component. The passive signal compensation components may perform various signal conditioning functions including filtering among others.

BRIEF DESCRIPTION OF THE DRAWINGS

FIG. 2 illustrates an isometric view of a backplane assembly having a contact pulled outward therefrom in accordance with an embodiment of the present invention.

DETAILED DESCRIPTION OF THE INVENTION

Figure 1:
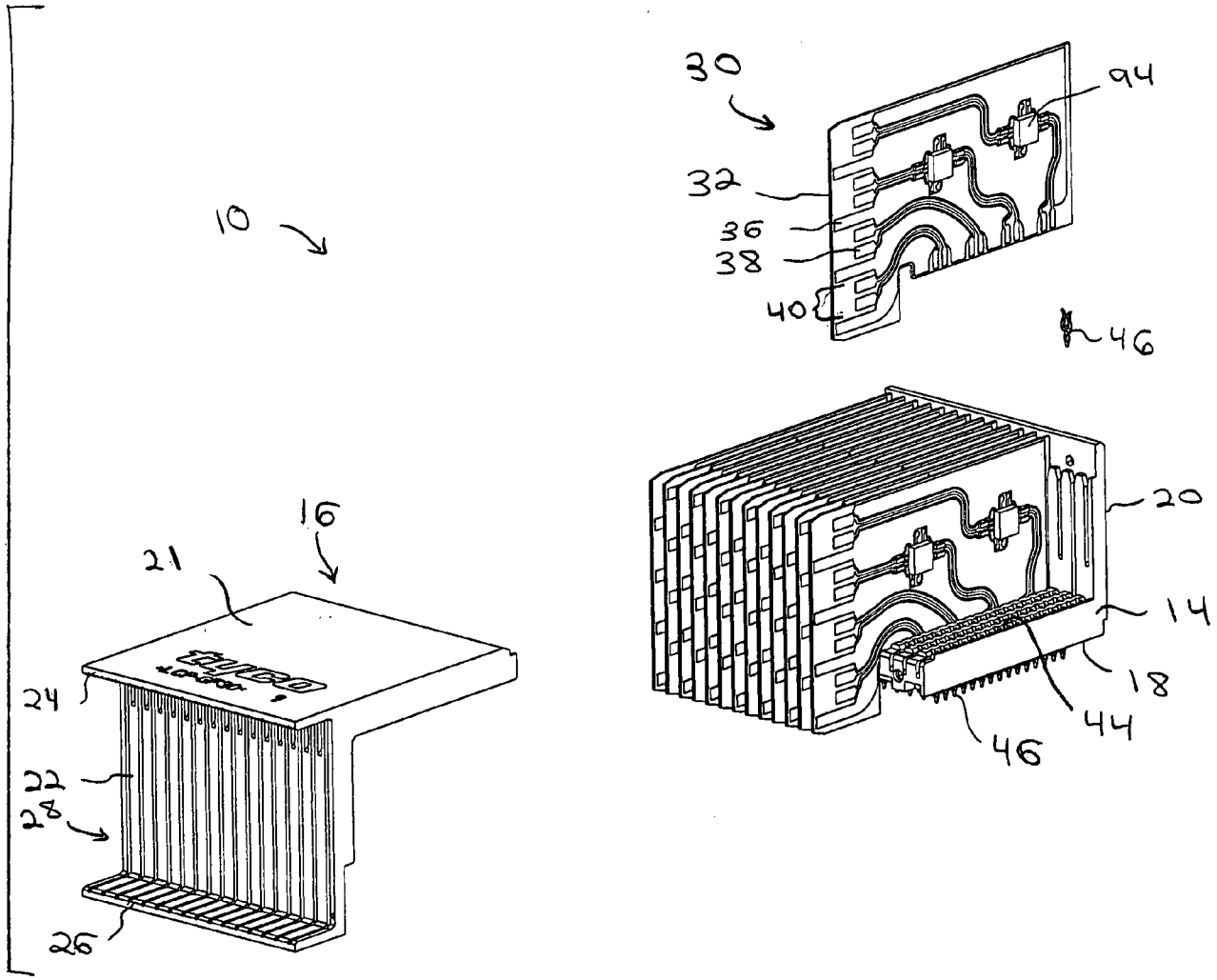
FIG. 1 illustrates an expanded isometric view of a connector assembly formed in accordance with an embodiment of the present invention.
Figure 8:
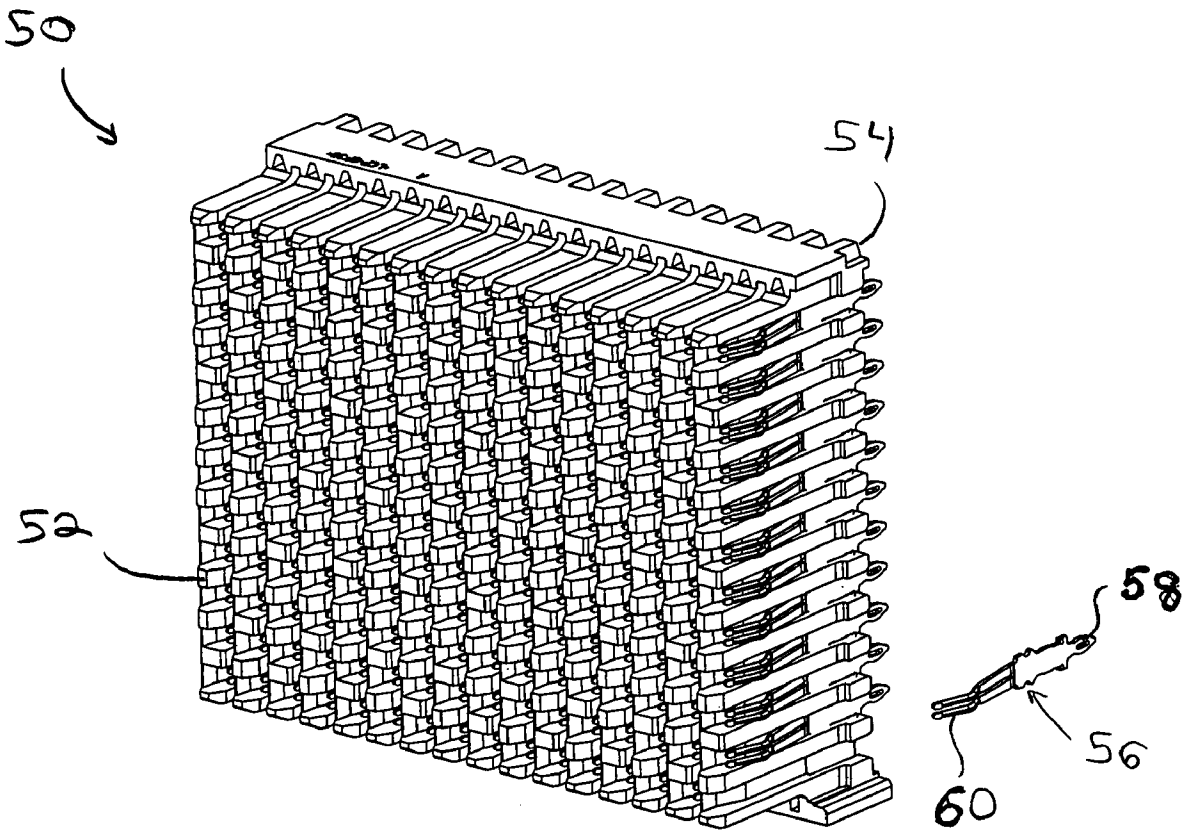

FIG. 1 illustrates a connector assembly 10 formed in accordance with an embodiment of the present invention. The connector assembly 10 includes a housing which includes an L-shaped frame 14 and an h-shaped cover 16 that mate with one another. The frame 14 includes a lower face that defines a daughter card interface 18 formed integrally with a backwall 20. The cover 16 comprises a top wall 21 formed integrally with a front wall defining a backplane assembly interface 22. The backplane assembly interface 22 includes upper and lower flanges 24 and 26 extending outward from the backplane assembly interface 22 to define a contact mating area (generally denoted by reference numeral 28). The frame 14 and cover 16 receive and retain a plurality of cards or wafers 30 which are arranged parallel to one another and spaced apart from one another. Optionally, the wafers 30 may be separated by ground shields (not shown). Each wafer 30 includes an edge defining a backplane edge 32 which extends through slots formed in the backplane assembly interface 22. The backplane edge 32 of each wafer 30 is provided with a series of ground and signal contact pads 36 and 38 arranged in a predefined sequence.

As shown in FIG. 1, the signal contact pads 38 are provided along one side of each wafer 30. The signal contact pads 38 are further arranged in differential pairs (one example of which is denoted by bracket 40), where each differential pair 40 of signal contact pads 38 is separated by a ground contact pad 36. The ground contact pads 36 are formed longer than the signal contact pads 38 to extend outward to the backplane edge 32. The signal contact pads 38 are positioned on the wafer 30 spaced slightly inward and from the backplane edge 32.

With reference to the daughter card interface 18, a series of positioning pins (not shown) are provided and are received in holes in a mating daughter card to facilitate alignment therebetween. The daughter card interface 18 includes a plurality of holes 44 through which contacts 46 project. The upper ends (not shown) of the contacts 46 mate with contact pads on the wafer 30 as explained below in more detail. The ends of the contacts 46 extending downward from the daughter card interface 18 are configured to be received in vias or through holes provided in a daughter card mated with the connector assembly 10.

FIG. 2 illustrates a backplane assembly 50 configured to be joined with the daughter card assembly 10 (FIG. 1). The backplane assembly 50 includes a front face 52 which fits in and mates with the contact mating area 28 (FIG. 1) of the backplane assembly interface 22 on the connector assembly 10. The backplane assembly 50 includes a back face 54 that is configured to be secured to a backplane printed circuit board (not shown). The backplane assembly 50 retains a plurality of contacts 56. Each contact 56 includes an eye of the needle contact tip 58 at one end and a dual beam tip 60 at the opposite end. When the backplane assembly 50 is mated with the connector assembly 10, the dual beam tips 60 press against corresponding ground and signal contact pads 36 and 38 on respective wafers 30.

Figure 3:
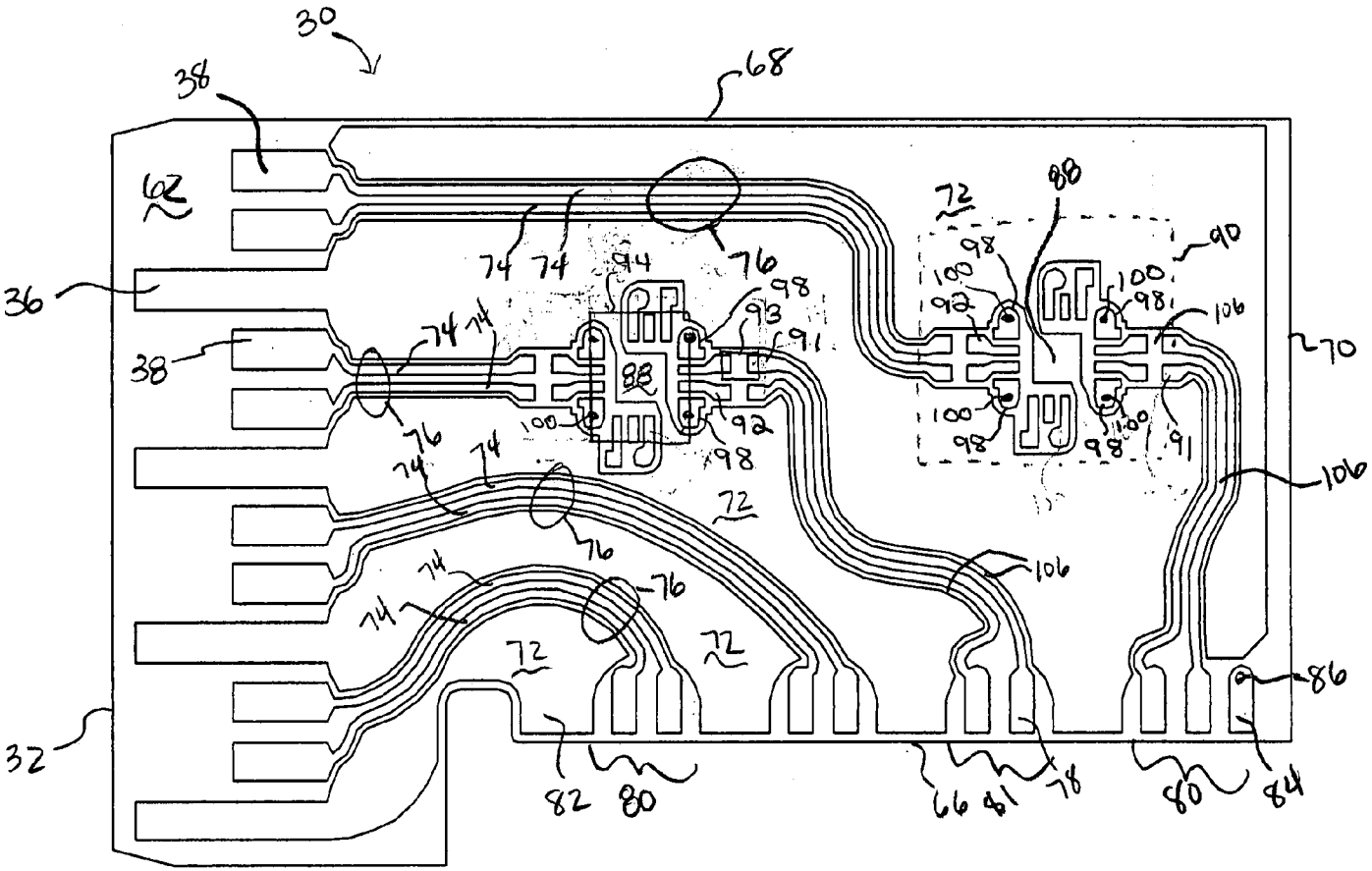
FIG. 3 illustrates one side of a wafer formed in accordance with an embodiment of the present invention.
Figure 4:
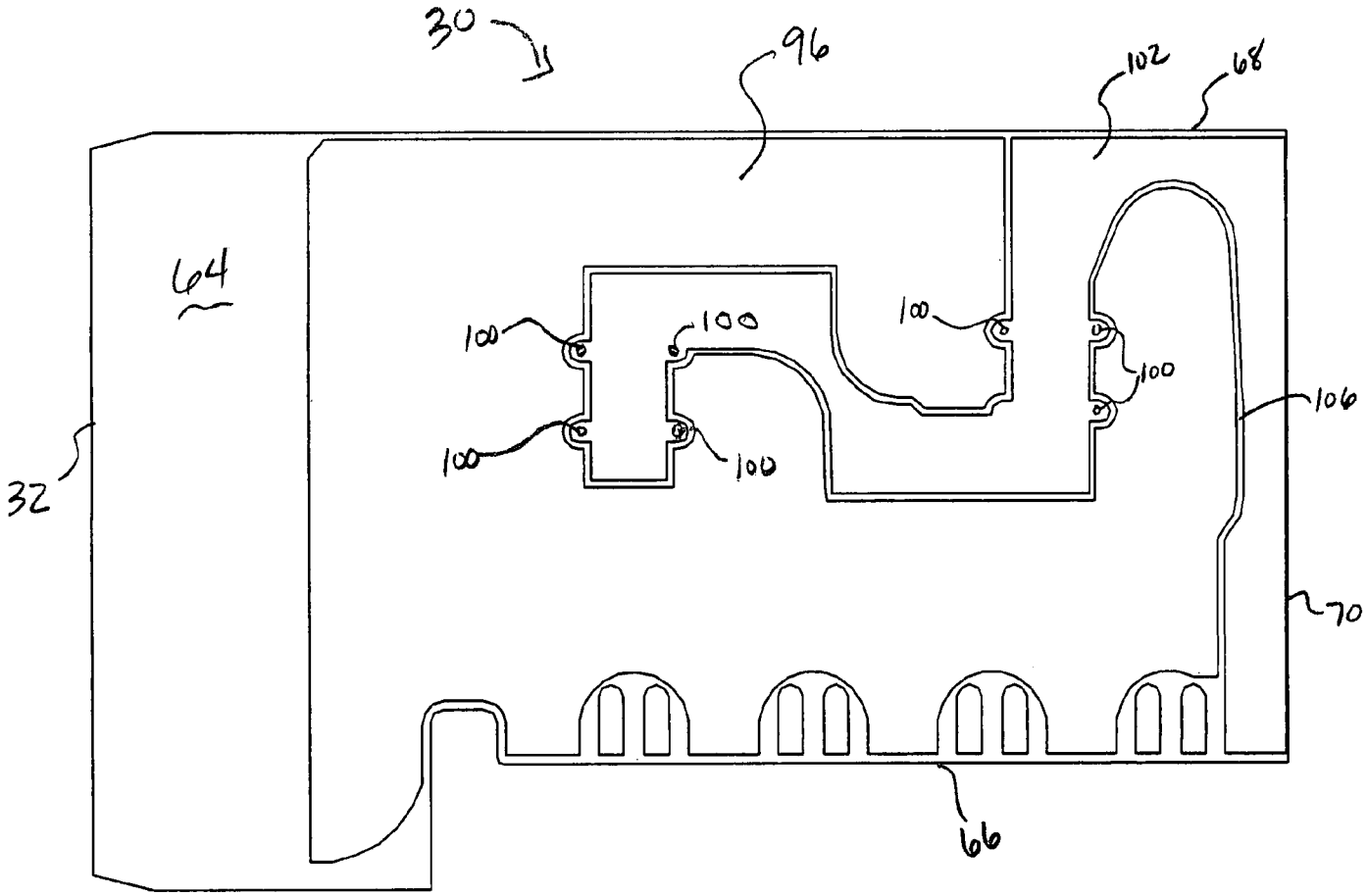
FIG. 4 illustrates an opposite side of the wafer of FIG. 3.

FIGS. 3 and 4 illustrate opposite sides of a wafer 30 formed in accordance with an embodiment of the present invention. For purposes of explanation only, the side illustrated in FIG. 3 will be referred to as the front side 62, while the side illustrated in FIG. 4 will be referred to as the back side 64. With reference to FIG. 3, the wafer 30 includes a backplane interface edge 32 oriented at a right angle to a daughter card interface edge 66. Optionally, the backplane and daughter card interface edges 32 and 66 may be oriented at acute or obtuse angles with respect to one another (or opposing one another at 180° angle). The wafer 30 also includes top and back edges 68 and 70, respectively. The front side 62 of the wafer 30 is formed with multiple ground plane sections 72 which are spaced apart to separate signal traces 74 that are arranged in differential pairs in the example of FIG. 3. The signal traces end at signal contact pads 38 proximate the backplane edge 32. The traces 74 also end at signal contact pads 78 proximate the daughter card interface edge 66.

The wafer 30 is configured to support a serial or unidirectional data stream within a point-to-point architecture, in which data signals are conveyed in a single direction through each signal trace 74. Hence, each individual signal contact pad 38 either only receives or only transmits signals within the entire point-to-point architecture, while the signal contact pads 78 operate in the exact opposite manner. Accordingly, individual signal contact pads 38 are configured as dedicated transmit or dedicated receive contact pads. By way of example only, a signal contact pad 38 may represent a dedicated receive or input contact pad that only receives serial signals, in which case the interconnected signal contact pad 78 will only and always operate as a dedicated transmit or output contact pad to transmit the serial signal.

The signal contact pads 78 are grouped into differential pairs 80, each of which is separated by ground contact pads 82. In addition, a power contact pad 84 is provided proximate the daughter card interface edge 66. The power contact pad 84 is joined at a via or through-hole 86 to a trace on the back side 64 of the module 30.

It is understood that while a first differential pair 76 of signal traces 74 support serial signal transmission in a first direction, a separate and distinct differential pair 76 of signal traces 74 on the same wafer 30 may support a different serial signal transmitting in the opposite direction. Hence, a first set of differential pairs 80 along the daughter card interface edge 66 may represent output contact pads, while a different differential pair 81 of signal contact pads 78, also along the daughter card interface edge 66, may constitute input contact pads.

In the example of FIG. 3, two differential pairs 76 of signal traces 74 include break sections 88 provided at intermediate points along the lengths of the signal traces. The break sections 88 form a disconnect in the signal traces 74 in which the break sections 88 are positioned. A component reception area 90, as denoted by a dashed line, surrounds each of the break sections 88. The component reception area 90 includes an arrangement of flared ends 91 on each signal trace 74. The flared ends are located proximate a gap 106. Component pads 92 are located across the gap 106 from the flared ends 91. Capacitors resistors and the like (generally denoted by reference numeral 93) may be provided to bridge the gap 106. By way of example, a capacitor 93 may be provided as a DC blocking capacitor bridging the gap 106 between a corresponding flared end 91 and component pad 92. Optionally, the capacitors, resisters and the like 93 and the gap 106 may be removed, such that the flared ends 91 of each signal trace 74 extend into and directly join with the active compensation component 94. In the example of FIG. 3, the active signal compensation component 94 includes pins that join the narrow portions of corresponding component pads 92 (for example, generally in line between the power pads 98). Individual signal traces 74 are divided into discrete and separate sections where each section is formed with flared end 91 at one end and either one of the signal contact pads 38 and 78 at the other end or another component pad 92.

An active compensation component 94 is illustrated as bridging one break section 88 in one differential pair 76 of signal traces 74. Optionally, a single active compensation component 94 may bridge breaks for multiple signals and/or differential pairs. The active compensation component 94 supports unidirectional signals in a point-to-point architecture. The active compensation component 94 compensates single-ended or differential signals that are incoming (by way of example) from the input contact pads (for example the signal contact pads 78). The active compensation component 94 compensates for signal degredation caused by the point-to-point architecture and outputs a corresponding single-ended or differential signal to the output contact pads (signal contact pads 38). The active compensation component 94 only transmits signals in a single direction, and does not support bi-directional communication over the signal traces 74. The active compensation component 94 receives power from power pads 98 which are joined, through vias 100, to power traces on the back side 64 of the wafer 30.

Active and/or passive components may perform signal compensation. The terms "signal compensation" and "compensation" are used broadly throughout the present application to refer to compensation for signal degradation in a system or point-to-point architecture. Signal degradation may be comprised of one or more of transmission medium losses, structural resonances, noise, radiation, jitter and the like. Examples of the functions that may be performed by active or passive signal compensation components include equalization, pre-emphasis, buffering/amplification, retiming, error correction and/or clock-data recover.

Optionally, the active compensation component 94 may perform amplification based upon a gain curve that is inversely associated with a loss curve corresponding to the particular configuration of signal traces 74 in use. The loss curve will vary between different wafers 30 depending upon the pattern of signal traces 74. The active compensation component 94 may adjust the gain introduced into the differential signals based on the level of power input to the active compensation component 94. Hence, remote control is afforded over the amount of gain by adjusting the power input. In addition, the active compensation component may include preemphasis functionality. The term "preemphasis" is used to refer to a process to define, within a band of frequencies, a magnitude of select frequencies (e.g. high frequency components) with respect to the magnitude of other select frequencies (e.g. lower frequency components). Preemphasis may improve the overall signal to noise ratio by reducing the adverse effects of certain phenomena such as attenuation differences in other parts of the system. Preemphasis may be used in part to account for the fact that high frequency components of the signals being conveyed through the signal traces 74 are attenuated to a more significant degree than low frequency components.

Optionally, the active compensation component 94 may simply constitute an equalizer or a repeater circuit.

FIG. 4 illustrates the back side 64 of the wafer 30. The back side 64 includes one or more of ground plane sections 96 arranged to substantially cover a majority of the back side 64. The back side 64 also includes a power trace 102 that extends from the daughter card interface edge 66 along the back edge 70 to the top edge 68. The power trace 102 extends in a curved manner to regions of the back side 64 directly across from and in alignment with the component reception areas 90 (FIG. 3). The power trace 102 is separated from the ground plane section 96 by a thin discontinuity 106 in the conductive materials. The ground plane sections 72, signal traces 74, component pads 92 and power pads 98 are separated by a disconnect 106 (FIGS. 3 and 4) in the conductive material. The power trace 102 interconnects with vias 100. The vias 100 interconnect the power trace 102 on the back side 64 (FIG. 4) with the power pads 98 on the front side 62 (FIG. 3).

The active compensation components 94 and the wafers 30 are designed and configured to convey single-ended or differential signals at very high data rates, such as 5 gigabits per second or more and up to 10 gigabits per second, or even higher.

Figure 5:
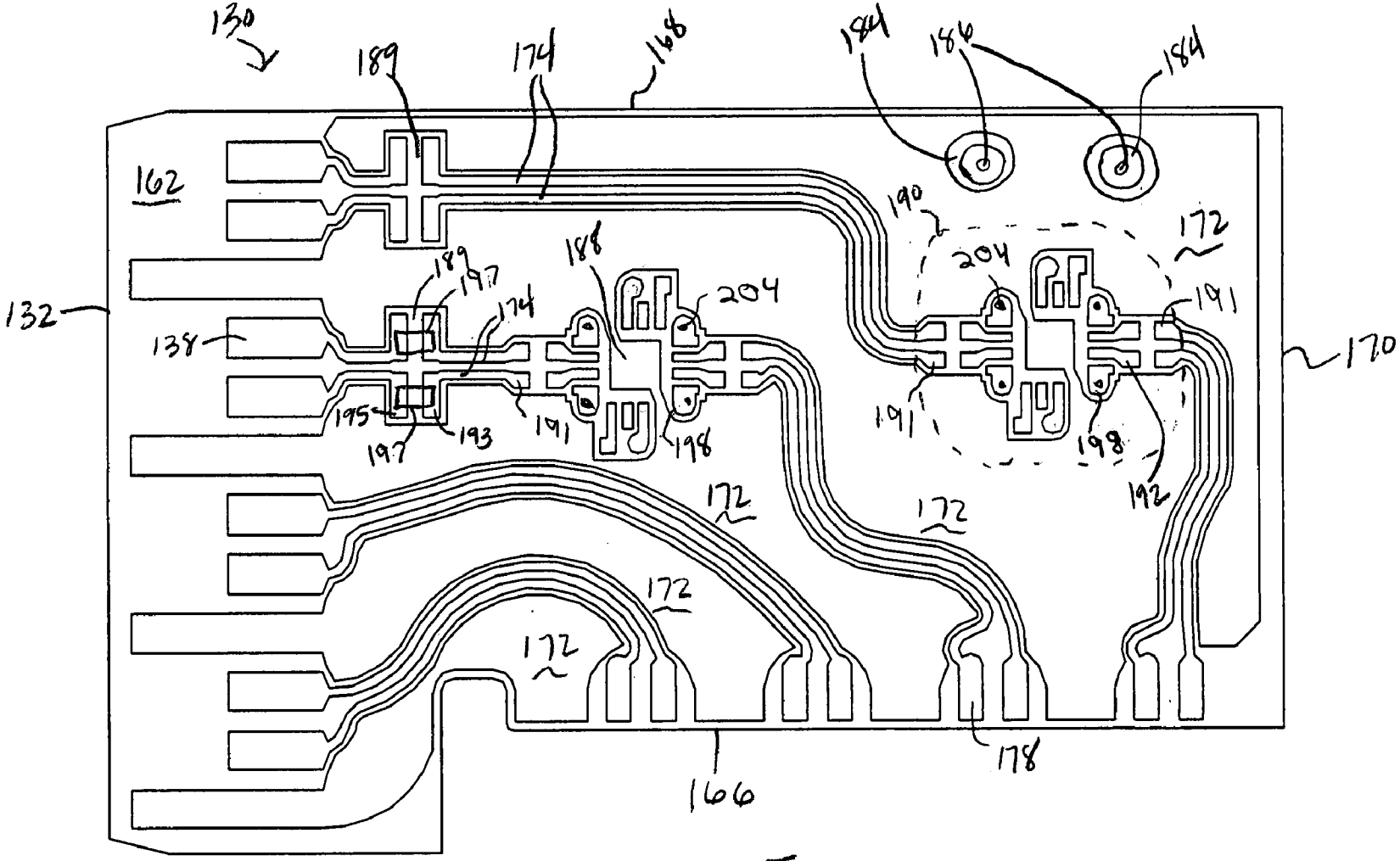
FIG. 5 illustrates one side of a wafer formed in accordance with an alternative embodiment of the present invention.
Figure 6:
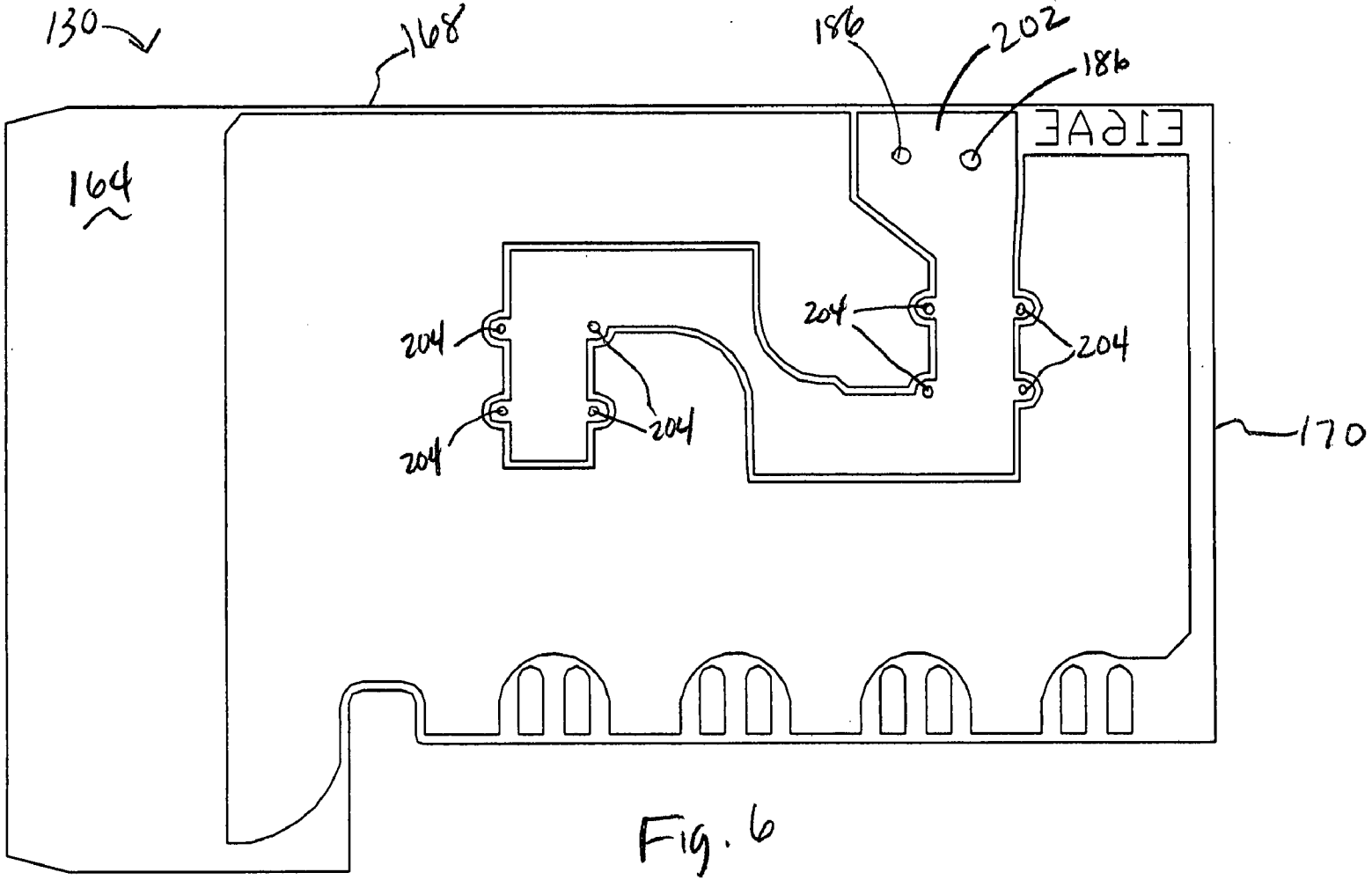
FIG. 6 illustrates an opposite side of the wafer of FIG. 5.

FIGS. 5 and 6 illustrate an alternative embodiment for a wafer 130. The wafer 130 includes a front side 162 (FIG. 5) and a back side 164 (FIG. 6). The wafer 130 includes ground plane sections 172 on the front side 162 which separate signal traces 174. Signal traces 174 include break sections 188 that form a disconnect. The break sections 188 are surrounded by component pads 192 and power pads 198 which join with corresponding signal and power pins on an active compensation component (not shown in FIG. 5). The signal traces 174 extend between signal contact pads 178 proximate the daughter card interface edge 166 and signal contact pads 138 proximate the backplane edge 132.

In the embodiment of FIGS. 5 and 6, an alternative configuration is provided for introducing the power source onto the wafer 130. The embodiment of FIGS. 5 and 6 does not include a power contact proximate the daughter card interface edge 166. Instead, a pair of power jumper contacts 184 are provided proximate the top edge 168 of the wafer 130. The power jumper contact pads join, through vias 186, to a power trace 202 (FIG. 6) provided on the back side 164 of the wafer 130. The power trace 202 extends from the top edge 168 downward at an intermediate point within the wafer 130 remote from the back side 164 in a somewhat S-shaped pattern. The power trace 202 joins with vias 204 located within the component reception area 190 (FIG. 5), but shown on the back side 164. The vias 204 join the power trace 202 on the back side 164 with power pads 198 on the front side 162.

As also illustrated in FIG. 5, each signal trace 174 may include more than one disconnect or break at flared ends 197. A second break section 189 is illustrated proximate the signal contact pads 138. The break section 189 may be configured to receive separate passive signal compensation components 197. The passive signal compensation components may be capacitors, resisters, inductors and the like, or combinations thereof. For each signal trace 174, the passive signal conditioning components 191 bridge between component pads 193 and 195 provided on opposite sides of the break section 189. The passive signal conditioning components 191 may filter the signals.

In accordance with at least one embodiment, active components are provided on the wafers to recover a serial data stream within a point-to-point architecture. By placing the active components on the wafer, the system length, and proportionally the loss, are divided into smaller stages which are more easily recovered. In addition, resonance between the backplane and daughter card plated through holes is interrupted. Signal losses are compensated, and a low cost method for signal recovery is provided.

Optionally, the power contact pad may be located proximate the backplane edge, top edge or back edge of the wafer.

Optionally, the wafers 30 may be modified to comprise a lead frame structure in which traces 74 are replaced with a lead frame arrangement. In the lead frame arrangement, the traces represent separate leads held within a chicklet or module which constitutes a wafer. The terms "trace" and "wafer" as used throughout may include "leads" and "chicklets," respectively.

Optionally, the wafers 30 may be configured to operate in a single-ended application, not in differential pairs.

While the invention has been described in terms of various specific embodiments, those skilled in the art will recognize that the invention can be practiced with modification within the spirit and scope of the claims.

What is claimed is:

1. An electrical connector for operation in a point-to-point system architecture, comprising:

an insulated housing having first and second card interfaces configured to mate with associated first and second circuit cards;

an electrical wafer held in said housing and configured to operate in a point-to-point architecture, said wafer having first and second interfaces, said signal traces ending at input and output contact pads proximate said first and second interfaces, respectively, said input contact pads receiving an uni-directional signal, said output contact pads transmitting said uni-directional signal, said signal traces including a first break at an intermediate point along a length thereof to form a disconnect in said signal traces; and an active compensation component bridging said first break in said signal traces, said active compensation component compensating said signal incoming from said input contact pads for signal degradation and transmitting an amplified, equalized signal outward to said output contact pads, said active compensation component transmitting said signal uni-directionally within the point-to-point architecture.

2. The electrical connector of claim 1, wherein said first and second card interfaces on said housing are oriented at right angles to one another.

3. The electrical connector of claim 1, wherein said first and second interfaces on said wafer are oriented at right angles to one another.

4. The electrical connector of claim 1, wherein said first and second card interfaces are configured to mate with a backplane and a daughter card.

5. The electrical connector of claim 1, wherein said wafer conveys a differential signal at a data rate of at least 5 Gigabits per second.

6. The electrical connector of claim 1, wherein said wafer conveys a differential signal at a data rate of at least 10 Gigabits per second.

7. The electrical connector of claim 1, wherein said active compensation component constitutes at least one of an equalizer and a signal repeater.

8. The electrical connector of claim 1, wherein said active compensation component includes pre-emphasis signal conditioning of said signal incoming from said input contact pads, said pre-emphasis signal conditioning increasing, within a band of frequencies, a magnitude of higher frequency components of said signal with respect to a magnitude of lower frequency components of said signal.

9. The electrical connector of claim 1, wherein said wafer includes a power contact pad located at said first interface and includes a power trace extending from said power contact pad to said active compensation circuit to provide power.

10. The electrical connector of claim 1, said wafer having first and second sides, wherein said active compensation component and a power contact pad are located on said first side, while a power trace is located on said second side, said power trace interconnecting said power contact pad and said active compensation component by through-holes extending through said wafer.

11. The electrical connector of claim 1, said wafer having first and second sides, wherein signal traces are located on said first side and a ground plane is located on said second side, said second side further including a power trace conveying power to said active compensation component.

12. The electrical connector of claim 1, wherein each of said signal traces including a second break at an intermediate point along a length thereof, said second breaks being separate and distinct from said first breaks, said connector further comprising passive signal compensation component bridging said second breaks.

13. The electrical connector of claim 1, further comprising a passive signal compensation component provided on said wafer along said signal traces and located between said active compensation component and said input contact pads, said passive signal conditioning component filtering said signal.

14. An electrical connector for operation in a point-to-point system architecture, comprising:

an insulated housing having a daughter card interface and a backplane interface configured to mate with an associated daughter card and backplane;

an electrical wafer held in said housing and configured to operate in a point-to-point architecture, said wafer having daughter card and backplane interfaces, said wafer having signal traces extending between input and output contact pads that are located proximate said daughter card interface and said backplane interface, said input contact pads receiving serial signals, said output contact pads transmitting said serial signals, said signal traces including a first break at an intermediate point along a length thereof to form a disconnect in said signal traces; and an active compensation component bridging said first break in said signal traces, said active compensation component compensating said serial signals incoming from said input contact pads for signal degradation and transmitting compensated serial signals outward to said output contact pads, said active compensation component only transmitting said serial signals uni-directionally within the point-to-point architecture.

15. The electrical connector of claim 14, wherein said active compensation component includes pre-emphasis signal conditioning of said serial signals incoming from said input contact pads, said pre-emphasis signal conditioning increasing, within a band of frequencies, a magnitude of higher frequency components of said serial signals with respect to a magnitude of lower frequency components of said serial signals.

16. The electrical connector of claim 14, wherein said wafer includes a power contact pad located at one of said daughter card interface and backplane interface and includes a power trace extending from said power contact pad to said active compensation component to provide power.

17. The electrical connector of claim 14, said wafer having first and second sides, wherein said active compensation component and a power contact pad are located on said first side and a power trace is located on said second side, said power trace interconnecting said power contact pad and said active compensation component by through-holes extending through said wafer.

18. The electrical connector of claim 14, said wafer having first and second sides, wherein signal traces are located on said first side and a ground plane is located on said second side, said second side further including a power trace conveying power to said active compensation component.

19. The electrical connector of claim 14, wherein each of said signal traces including a second break at an intermediate point along a length thereof, said second breaks being separate and distinct from said first breaks, said connector further comprising passive signal compensation components bridging said second breaks.

20. The electrical connector of claim 14, further comprising a passive signal conditioning component provided on said wafer along said signal traces and located between said active compensation component and said input contact pads, said passive signal conditioning component filtering said serial signals.

* * * * *